United States Patent [19]

Da Fonte, Jr.

[11] 4,359,347

[45] Nov. 16, 1982

[54] CHROMIUM-FREE PASSIVATE SOLUTION AND PROCESS

[75] Inventor: Bento Da Fonte, Jr., Mt. Clemens, Mich.

[73] Assignee: Occidental Chemical Corporation, Warren, Mich.

[21] Appl. No.: 254,728

[22] Filed: Apr. 16, 1981

[51] Int. Cl.[3] ..... C23F 9/00; C23F 7/00

[52] U.S. Cl. ..... 148/6.14 R; 148/6.24

[58] Field of Search ..... 148/6.14 R, 6.24

[56] References Cited

U.S. PATENT DOCUMENTS 3,852,124 12/1974 Fassell ..... 148/6.14 R

*Primary Examiner*—James R. Hoffman

*Attorney, Agent, or Firm*—Richard P. Mueller

[57] ABSTRACT

An aqueous acidic solution and process for treating receptive metal surfaces, particularly zinc and zinc alloy surfaces, to impart a passivate film thereon imparting improved corrosion resistance thereto. The aqueous solution contains effective amounts of hydrogen ions to provide a pH of about 1.2 to about 2.5, an oxidizing agent and a combination of iron and cobalt ions present in an amount effective to activate the bath and promote the formation of a passivate film on the metal substrate. The treating solution may optionally further contain cerium ions present in an amount to further activate the bath and to impart a light-yellow color to the passivate film, halide ions and a wetting agent.

21 Claims, No Drawings

CHROMIUM-FREE PASSIVATE SOLUTION AND PROCESS

BACKGROUND OF THE INVENTION

A variety of chromium containing aqueous solutions have heretofore been used or proposed for treating zinc, zinc alloy, cadmium, cadmium alloy and aluminum surfaces for improving the corrosion resistance properties thereof. Such treating solutions originally contained chromium in the hexavalent state and in more recent years the chromium constituent was present as a mixture of the hexavalent and trivalent forms. The reduced toxicity of trivalent chromium and the increased simplicity and efficiency in treating waste effluents containing trivalent chromium has occasioned an increased commercial use of passivate solutions in which the chromium constituent is substantially entirely in the trivalent state. The present invention is directed to a passivating solution which does not contain any chromium ions and is effective for imparting corrosion resistance to zinc, cadmium and aluminum surfaces as well as alloys thereof.

Typical of prior art chromium-free compositions and processes for treating metal surfaces are those disclosed in U.S. Pat. Nos. 3,539,402; 3,539,403; 3,586,543; 3,682,713; 3,687,740 and 3,843,430.

The present invention provides a treating solution and process which is effective to selectively impart a clear blue-bright or a clear light-yellow passivate film to zinc, zinc alloy, cadmium, cadmium alloy, aluminum and magnesium surfaces which provides for improved corrosion resistance. The present invention is further characterized by a process which is simple to control and operate and which is of efficient and economical operation.

SUMMARY OF THE INVENTION

The benefits and advantages of the present invention are achieved in accordance with the composition aspects thereof by providing an aqueous acidic treating solution containing as its essential constituents hydrogen ions to provide a solution pH of about 1.2 to about 2.5 which can be conveniently introduced by mineral acids such as sulfuric acid, nitric acid, hydrochloric acid or the like; an oxidizing agent of which hydrogen peroxide itself is preferred present in an amount of about 1 to about 20 g/l, iron and cobalt ions in an amount of about 0.02 to about 1 g/l to form a blue-bright or clear passivate film, and, if desired, cerium ions present in an amount effective to further activate the bath and to promote the formation of a clear light-yellow passivate film on the treated substrate. The solution may optionally also contain halide ions for imparting hardness to the coating in addition to a small amount of a wetting agent.

In accordance with the process aspects of the present invention, zinc, cadmium, zinc alloy, cadmium alloy, aluminum and magnesium surfaces are contacted with the aqueous acidic treating solution at a temperature ranging from about 40° up to about 150° F. for a period of time typically ranging from about 10 seconds up to about 1 minute to form the desired passivate film.

Additional benefits and advantages will become apparent on a reading of the Description of the Preferred Embodiments taken in conjunction with the specific examples provided.

DESCRIPTION OF THE PREFERRED EMBODIMENTS

The present invention is particularly applicable but not limited to the treatment of alkaline and acidic non-cyanide zinc and cadmium electrodeposits to impart improved corrosion resistance thereto. Particularly satisfctory results are obtained on decorative zinc and cadmium electrodeposits of the bright and semi-bright types although beneficial effects are also achieved on zinc and zinc alloy substrates such as galvanized substrates, zinc die cstings and substrates comprised of cadmium or alloys of cadmium predominantly comprised of cadmium. While the invention as herein described is particularly directed to the treatment of zinc and zinc alloy surfaces, it has been observed that beneficial results are also obtained in the treatment of aluminum, aluminum alloy, magnesium and magnesium alloy surfaces to form a passivate film or coating thereon. Accordingly, the present invention in its broad sense is directed to the treatment of metal surfaces which are receptive to the formation of a passivate film thereon when contacted with the solution of the present invention in accordance with the process parameters disclosed.

In accordance with the present invention, the treating solution contains as its essential constituents, hydrogen ions to provide a pH of from about 1.2 to about 2.5, an oxidizing agent in an amount effective to activate the metal surface and to form a passivate film thereon, and iron and cobalt ions present in an amount effective to activate the bath and to impart integral hardness to the passivate film. The treating solution may optionally further contain cerium ions present in an amount effective to further activate the bath and to promote the formation of a light-yellow passivate film. Additionally, the treating solution may optionally contain halide ions including fluoride, chloride and bromide ions for increasing the hardness of the passivate film as well as one or more compatible wetting agents for achieving efficient contact with the substrate being treated.

The treating bath contains hydrogen ions in an amount to provide a pH of about 1.2 to about 2.5 with a pH range of about 1.5 to about 2.0 being preferred. Acidification of the operating bath to within the desired pH range can be achieved by a variety of mineral acids and organic acids such as sulfuric acid, nitric acid, hydrochloric acid, formic acid, acetic acid, propionic acid and the like of which sulfuric acid and nitric acid are preferred. The presence of sulfate ions in the bath has been found beneficial in achieving the desired passivation of the substrate and can be introduced by the sulfuric acid addition or sulfate salts of the other bath constituents. Sulfate ion concentrations can range in amounts up to about 15 g/l with concentrations of from about 0.5 to about 5 g/l being preferred.

The treating bath further contains an oxidizing agent or agents which are bath compatible of which peroxides including hydrogen peroxide and metal peroxides such as the alkali metal peroxides are preferred. Hydrogen peroxide itself of a commercial grade containing about 25% to about 60% by volume peroxide constitutes the preferred material. Other peroxides that can be employed include zinc peroxide. Additionally, ammonium and alkali metal persulfates have also been found effective as oxidizing agents.

The concentration of the oxidizing agent or mixture of oxidizing agents is controlled to achieve the desired surface appearance of the treated substrate. Typically, the concentration of the oxidizing agent can range from about 1 to about 20 g/l with an amount of about 3 to about 7 g/l being preferred, calculated on a weight equivalent effectiveness basis to hydrogen peroxide.

In addition to the foregoing, the bath further contains iron and cobalt ions to activate the bath and to form a clear colorless to light-blue passivate film. The iron and cobalt ions are conveniently introduced into the bath by way of bath soluble and compatible salts including sulfates, nitrates, halide salts, or the like. The concentration of the combined iron and cobalt ions to achieve appropriate activation of the treating bath is controlled within a range of about 0.02 to about 1 g/l, preferably within a range of about 0.1 to about 0.2 g/l. The iron and cobalt ions individually are present in an amount of about 0.01 to about 0.5 g/l with individual amounts of about 0.05 to about 0.1 g/l being preferred.

When a passivate film is desired having a light-yellow appearance, the treating bath further contains cerium ions present in an amount effective to further activate the bath and to impart a clear yellowish color, preferably an iridescent light-yellow color to the passivate film on the substrate treated. The cerium ions can be introduced in the form of any bath soluble and compatible cerium salt including cerium sulfate [$Ce(SO_4)_2.4H_2O$]; halide salts such as cerous chloride [$CeCl_3.6H_2O$]; nitrate salts such as cerium nitrate [$Ce(NO_3).5H_2O$], [$Ce(NO_3)_3(OH).3H_2O$] and the like. Usually, at least some of the cerium ions are introduced into the bath in the tetravalent state to impart the characteristic yellow color of the tetravalent cerium ion into the passivate film. Certain oxidizing agents such as hydrogen peroxide, act as a reducing agent under the acid conditions prevalent in the bulk of the operating bath and reduce some of the tetravalent cerium ions to the trivalent state. However, oxidizing agents such as hydrogen peroxide revert from a reducing agent to an oxidizing agent at the interface of the substrate being treated due to the higher pH prevalent at the interface and oxidize at least some of the trivalent cerium ions to the tetravalent state which are deposited in the film and impart the characteristic yellow color thereto. When using such oxidizing agents as hydrogen peroxide, accordingly, all of the cerium ions can, if desired, be initially introduced into the operating bath in the trivalent state of which a portion are oxidized to the tetravalent state at the interface of the substrate. The passivate film usually contains a mixture of trivalent and tetravalent cerium compounds and the intensity of the yellow color of the film is dictated by the concentration of the tetravalent cerium compounds present. The cerium ions in addition to imparting a light-yellow color to the passivate film also improves the corrosion resistance of the treated substrate. The cerium sulfate compound, due to solubility difficulties, is preferably added to the bath in the form of an acid solution such as a dilute sulfuric acid solution containing the cerium sulfate dissolved therein.

The concentration of cerium ions in the operating bath can range from about 0.5 up to about 10 g/l with concentrations of from about 1.0 to about 4.0 g/l being preferred. The concentration of cerium ions is in part influenced by the magnitude of the yellow coating desired and higher concentrations of the ceriuim ions produce corresponding increases in the yellow color of the passivate film.

Because of cost considerations, the cerium ions are preferably introduced as a commercially available mixture of rare earth salts of metals in the lanthanide series which contains cerium compounds as the principal component. One such commercially available material is a cerous chloride solution containing about 46% solids of which $CeCl_3.6H_2O$ predominates. The cerous chloride solution is derived from rare earth oxide (REO) concentrate sold by Molycorp, Inc. of White Plains, New York under product code 5310 containing a minimum of 99 percent total REO of which $CeO_2$ is 96%, $La_2O_3$ is 2.7%, $Nd_2O_3$ is 1% and $Pr_6O_{11}$ is 0.3%. A ceric sulfate solution is commercially available from the same source containing about 42% solids of which $Ce(SO_4)_2.H_2O$ predominates and which is also prepared from product code 5310 containing other rare earth metal compounds in similar minor amounts.

As an optional but preferred constituent, the bath contains halide ions including chlorine, bromine and flourine ions which have been found to enhance the hardness of the passivate film on the treated substrate. The halide ions or mixtures thereof can conveniently be introduced employing any of the alkali metal and ammonium salts thereof as well as salts of the metal ions hereinabove set forth. The concentration of the total halide constituent in the bath normally may range up to about 8 grams per liter with concentrations of about 0.1 to about 2.5 g/l being typical.

In addition to the foregoing, the use of a small effective amount of a variety of bath compatible wetting agents also provides beneficial results in the nature of the passivate film deposited. When employed, the wetting agent can be present in concentrations up to about 1 g/l with concentrations of about 50 to about 100 mg/l being preferred.

Wetting agents suitable for use in the treating bath include aliphatic fluorocarbon sulfonates available from 3 M under the Fluorad brandname, such as, for example, Fluorad FC 98, which is a non-foaming wetting agent and its use at about 100 mg/l in the working bath improves the color and hardness of the passivate film. A second class of suitable wetting agents is the sulfo derivatives of succinates. An example of this class is Aerosol MA-80 which is dihexyl ester of sodium sulfosuccinic acid and is commercially available from American Cyanamid Company. A third class of suitable wetting agents is the sulfonates of naphthalene which are linear alkyl naphthalene sulfonates, such as Petro BA, for example, available from Petrochemical Company.

In accordance with the process aspects of the present invention, a treating bath formulation as hereinabove described is applied to a substrate to be treated by spray, immersion, flooding or the like for a period of time sufficient to form the desired passivate film thereon. The treating solution is controlled within a temperature range of about 40° to about 150° F., with a temperature range of about 70° to about 90° F. being preferred. Temperatures above about 90° F. have a tendency to cause a rapid loss of the peroxide-type oxidizing agents when used whereas temperatures below about 70° F. reduce the activity of the bath requiring increased contact times to achieve a passivate film of the same thickness or color intensity as can be achieved at the higher temperatures at shorter time intervels. Typically, contact times of about 30 seconds to about 1 minute are satisfactory with contact times of about 30 seconds being usually preferred.

The operating bath can be conveniently prepared by employing a concentrate containing the active constituents with the exception of the cerium ions and oxidizing agent which is adapted to be diluted with water to which the cerium ions, if employed, and oxidizing agent are separately added to form a bath containing the constituents within the desired concentration range. Similarly, replenishment of the bath on a continuous or intermittent basis can be achieved employing a concentrate of the active constituents with the exception of the cerium ions and oxidizing agent which are individually added separately to the operating bath. Typically a bath make-up concentrate can contain from about 0.5 to about 50 g/l of iron and cobalt ions, halide ions up to about 20 g/l and a suitable surfactant in an amount up to about 5 g/l if employed. Such a make-up concentrate is adapted to be diluted with about 96 volume percent water to which cerium ions, if employed, and an oxidizing agent are added to produce an operating bath containing the active constituents within the ranges specified. The oxidizing agent such as hydrogen peroxide, for example, is separately introduced into the bath preferably in a form commercially available containing from about 35 to 40 percent by volume hydrogen peroxide.

As previously advised, the low solubility of cerium sulfate makes it desirable to introduce this constituent into the operating bath in the form of an aqueous acidic solution. Normally, the use of cerium sulfate in the high concentrations necessary to form a concentrate with the remaining active constituents other than the peroxide constituent causes precipitation of the cerium compound. Even when the cerium is introduced as a halide or nitrate salt, the presence of sulfate ions in the concentrate employed introduced by the other constituents causes precipitation. Accordingly, the cerium concentrate is preferably formed as a separate addition component and may comprise aqueous acidic solutions of cerous chloride or ceric sulfate having a cerium ion concentration of from about 200 to about 320 g/l and about 60 to 100 g/l, respectively. Such cerium concentrates may conveniently be comprised of the commercially available materials hereinbefore described available from Molycorp, Inc.

In order to further illustrate the present invention, the following examples are provided. It will be understood that the examples are provided for illustrative purposes and are not intended to be limiting of the scope of the invention as herein disclosed and as set forth in the subjoined claims.

EXAMPLE 1

A chromium-free passivating concentrate is prepared containing 12 g/l ammonium bifluoride, 12 g/l ferrous ammonium sulfate, 80 g/l cobalt sulfate, and 4.5% by volume of concentrated sulfuric acid. A working bath is prepared comprising water to which 2% by volume of the foregoing passivating concentrate is added in addition to 1.5 volume percent hydrogen peroxide (38% concentration).

Test panels containing a bright electroplated zinc deposit which are water rinsed after the electroplating step and are rinsed in a 5% by volume dilute nitric acid solution are immersed in the operating passivating bath for a period of 20 seconds in the presence of mild agitation. Thereafter the test panels are water rinsed and air dried. The test panels after drying are visually inspected and are characterized as having a uniform clear bluish passivating film on the surface thereof. The operating bath has a nominal pH of about 1.5 to about 2.0.

EXAMPLE 2

In order to produce a light-yellow iridescent passivate film on zinc electroplated test panels, cerium ions are introduced in a test operating bath containing 2% by volume of the chromium-free passivating concentrate as described in Example 1, 2% by volume of a cerium sulfate concentrate comprising a 6% cerium sulfate [$Ce(SO_4)_2$] solution in a dilute sulfuric acid solution and 1.5% by volume of a hydrogen peroxide concentrate (38%). The nominal pH of the operating bath is about 1.5 to about 2.0.

The zinc test panels after plating, water rising and a nitric acid dip are immersed in the test solution in the presence of mild agitation for a period of 45 seconds. The treated test panels are water rinsed and air dried. A visual inspection of the surface of the test panel reveals a substantially uniform light-yellow iridescent passivate film.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acidic solution for treating recpetive metal substrates to impart a passivate film thereon comprising an acid, a solution compatible peroxide or persulfate oxidizing agent, and iron and cobalt ions present in an effective ammount to impart increased corrosion resistance to the treated substrate.

2. The aqueous solution as defined in claim 1 having a pH of about 1.2 to about 2.5.

3. The aqueous solution as defined in claim 1 having a pH of about 1.5 to about 2.0.

4. The aqueous solution as defined in claim 1 in which said acid is a mineral acid selected from the group consisting of sulfuric, nitric, hydrochloric and mixtures thereof.

5. The aqueous solution as defined in claim 1 in which said oxidizing agent is present in an amount of about 1 to about 20 g/l calculated on a weight equivalent effectiveness basis to hydrogen peroxide.

6. The aqueous solution as defined in claim 1 in which said oxidizing agent is present in an amount of about 3 to about 7 g/l calculated on a weight equivalent effectiveness basis to hydogen peroxide.

7. The aqueous solution as defined in claim 1 in which said oxidizing agent comprises a peroxide.

8. The aqueous solution as defined in claim 1 in which said oxidizing agent comprises hydrogen peroxide.

9. The aqueous solution as defined in claim 1 further containing sulfate ions in an amount up to about 15 g/l.

10. The aqueous solution as defined in claim 1 further containing sulfate ions in an amount of about 0.5 to about 5 g/l.

11. The aqueous solution as defined in claim 1 in which said iron and said cobalt ions are present in an amount of about 0.02 to about 1 g/l.

12. The aqueous solution as defined in claim 1 in which said iron and said cobalt ions are present in an amount of about 0.1 to about 0.2 g/l.

13. The aqueous solution as defined in claim 1 further containing cerium ions present in an amount of about 0.5 to about 10 g/l.

14. The aqueous solution as defined in claim 1 further containing cerium ions present in an amount of about 1.0 to about 4 g/l.

15. The aqueous solution as defined in claim 1 further including halide ions.

16. The aqueous solution as defined in claim 15 in which said halide ions are present in an amount up to about 8 g/l.

17. The aqueous solution as defined in claim 15 in which said halide ions are present in an amount of about 0.1 to about 2.5 g/l.

18. The aqueous solution as defined in claim 1 further including a surfactant.

19. The aqueous solution as defined in claim 18 in which said surfactant is present in an amount up to about 1 g/l.

20. The aqueous solution as defined in claim 18 in which said surfactant is present in an amount of about 50 to about 100 mg/l.

21. A process for treating a receptive metal substrate to impart a passivate film thereon which comprises the steps of compacting the substrate with a solution at a temperature of about 40° to about 150° F. having a composition of claim 1 or 2 or 3 or 4 or 5 or 6 or 7 or 8 or 9 or 10 or 11 or 12 or 13 or 14 or 15 or 16 or 17 or 18 or 19 or 20 for a period of time sufficient to form a passivate film thereon.

* * * * *